US010787010B2

(12) United States Patent
Tsukuda et al.

(10) Patent No.: US 10,787,010 B2
(45) Date of Patent: Sep. 29, 2020

(54) PRINT MEDIA FEEDING APPARATUS AND PRINTING APPARATUS

(71) Applicant: CANON KABUSHIKI KAISHA, Tokyo (JP)

(72) Inventors: Masakazu Tsukuda, Yokohama (JP); Seiji Ogasawara, Machida (JP); Takaaki Ishida, Kawasaki (JP); Shuichi Tokuda, Kawasaki (JP); Masaaki Matsuura, Kawasaki (JP); Kazuki Matsuo, Kawasaki (JP); Motoyuki Taguchi, Komae (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/222,316

(22) Filed: Dec. 17, 2018

(65) Prior Publication Data

US 2019/0193432 A1 Jun. 27, 2019

(30) Foreign Application Priority Data

Dec. 22, 2017 (JP) ..... 2017-246816

(51) Int. Cl.
*B41J 13/00* (2006.01)
*B41J 11/04* (2006.01)
(Continued)

(52) U.S. Cl.
CPC ..... *B41J 13/0045* (2013.01); *B41J 11/007* (2013.01); *B41J 11/04* (2013.01); *B41J 13/025* (2013.01); *B41J 13/103* (2013.01)

(58) Field of Classification Search
CPC .... B41J 13/0045; B41J 13/103; B41J 13/025; B41J 11/04; B41J 11/007
See application file for complete search history.

(56) References Cited

U.S. PATENT DOCUMENTS 4,709,915 A 12/1987 Ishikawa et al.
4,974,828 A 12/1990 Matsuo et al.
(Continued)

FOREIGN PATENT DOCUMENTS

JP 2011-236054 A 11/2011

OTHER PUBLICATIONS

U.S. Appl. No. 16/223,729, Masakazu Tsukuda, Seiji Ogasawara, Takaaki Ishida, Shuichi Tokuda, Masaaki Matsuura, Kazuki Matsuo, filed Dec. 18, 2018.

*Primary Examiner* — Bradley W Thies
(74) *Attorney, Agent, or Firm* — Venable LLP

(57) ABSTRACT

A print media feeding apparatus includes a stacking part configured to stack print media; a feeding roller which is movable to an abutting position at which the feeding roller contacts the print media stacked on the stacking part and to a separated position separated from the print media stacked on the stacking part and configured to feed a print medium by rotating at the abutting position; a separation member configured to separate the print media; and a return unit configured to perform a return operation of returning the print medium other than a top print medium which the feeding roller abuts. The feeding roller moves to the separated position after feeding the print medium from the stacking part. The return unit performs the return operation upon the feeding roller moving to the separated position. After the return operation, the feeding roller stops at the abutting position.

12 Claims, 18 Drawing Sheets

(51) Int. Cl.

| | |
|---|---|
| ***B41J 11/00*** | (2006.01) |
| ***B41J 13/10*** | (2006.01) |
| ***B41J 13/02*** | (2006.01) |

(56) References Cited

U.S. PATENT DOCUMENTS

| | | | | |
|---|---|---|---|---|
| 5,050,860 | A | 9/1991 | Matsuo et al. | |
| 9,890,001 | B2 | 2/2018 | Taniguchi et al. | |
| 2008/0002010 | A1* | 1/2008 | Nakashima | B41J 13/103 347/104 |
| 2013/0221604 | A1* | 8/2013 | Matsushima | B65H 1/266 271/10.11 |
| 2014/0125002 | A1* | 5/2014 | Itabashi | B65H 7/00 271/10.13 |

* cited by examiner

PRINT MEDIA FEEDING APPARATUS AND PRINTING APPARATUS

BACKGROUND OF THE INVENTION

Field of the Invention

The present invention relates to a print media feeding apparatus configured to feed from a stacking part and convey a print medium, and a printing apparatus including the same.

Description of the Related Art

A printing apparatus configured to perform printing on a sheet-like print medium performs a printing operation by feeding a print medium from a feeding cassette housing a plurality of stacked sheets of print media, further sending the fed print medium to a print unit by a conveying unit such as a conveying roller. On this occasion, it becomes necessary to feed a sheet of the print media to the print unit without a plurality of sheets of the print media being overlapped. Accordingly, there is known a conventional printing apparatus including a separation mechanism which, in the case where a plurality of sheets of the print media are sent out from the feeding cassette in an overlapped state, separates only a single sheet of the print media among the plurality of sheets of the print media, and supplies it to the print unit.

Japanese Patent Laid-Open No. 2011-236054 discloses a feeding apparatus configured as illustrated in FIG. 18. The feeding apparatus illustrated in FIG. 18 includes a pickup roller 123 that sends print media S stacked within a feeding cassette 122 to the outside. The pickup roller 123 is supported in manner movable upward and downward by an arm 124 being moved by rotation of a shaft 127. At the time of feeding, the pickup roller 123 rotating by the drive of a motor descends from an upper retracted position, and abuts the surface (top surface) of the top print medium S1 of the print media S stacked within the feeding cassette 122. Accordingly, the print media S are fed from the feeding cassette 122 by the rotating pickup roller 123.

The print media S fed from the feeding cassette 122 are nipped between a feeding roller 115 and a separation roller 116 being biased toward the feeding roller 115. On this occasion, there is a possibility that a plurality of sheets of the print media S fed by the pickup roller 123 may be nipped between both feeding rollers 115 and 116. However, the separation roller 116, being connected to a torque limiter, is configured to apply braking to the movement in the feed direction of the print media other than the top print medium S1 contacting the feeding roller 115, so that only the top sheet of the print media is fed downstream.

However, with the unit disclosed in Japanese Patent Laid-Open No. 2011-236054, the impact at the time of abutment of the pickup roller 123 to the print media S stacked on the feeding cassette 122 causes a gap to be formed between the feeding roller 115 and the separation roller 116, which may cause double-feeding. In other words, in the case where a gap is formed between the feeding roller 115 and the separation roller 116, a plurality of sheets of the print media S sent out from the stacking part in an overlapped state may pass through the gap formed between feeding roller 115 and the separation roller 116, which may lead to double-feeding.

SUMMARY OF THE INVENTION

It is an object of the present invention to provide a feeding apparatus capable of reliably feeding print media one by one from a stacking part.

The present invention provides a print media feeding apparatus comprising: a stacking part configured to stack the print media; a feeding roller which is movable to an abutting position at which the feeding roller contacts the print media stacked on the stacking part and to a separated position separated from the print media stacked on the stacking part and configured to feed a print medium by rotating at the abutting position; a separation member configured to separate the print media; and a return unit configured to perform a return operation of returning the print medium other than a top print medium which the feeding roller abuts, wherein the feeding roller moves to the separated position, after feeding the print medium from the stacking part, the return unit performs the return operation upon the feeding roller moving to the separated position and, after the return operation, the feeding roller stops at the abutting position.

According to the feeding apparatus pertaining to the present invention, it becomes possible to reliably feed the print media one by one from the stacking part.

Further features of the present invention will become apparent from the following description of exemplary embodiments with reference to the attached drawings.

DESCRIPTION OF THE EMBODIMENTS

Figure 1:
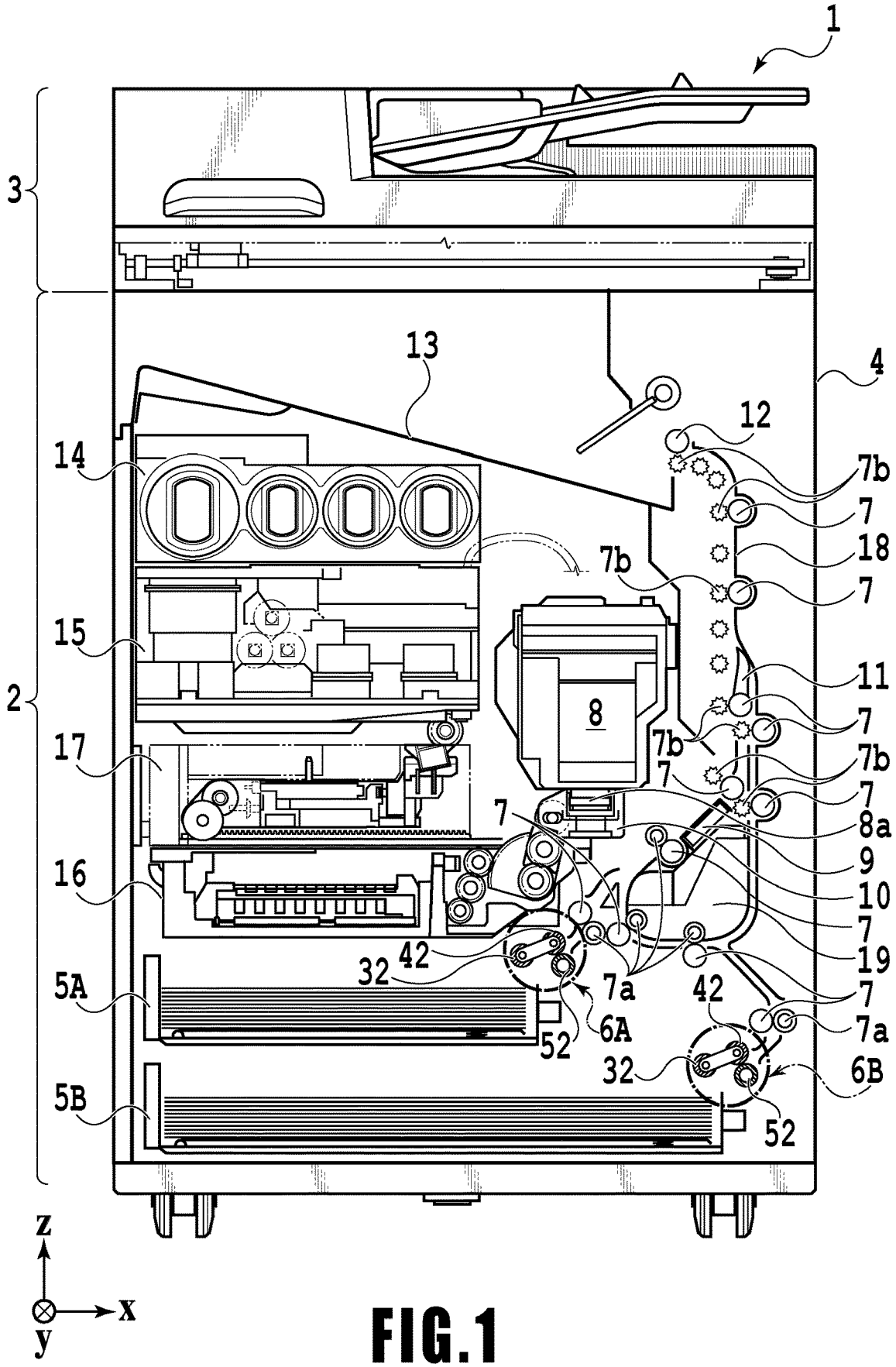
FIG. 1 is a front view of a printing apparatus in a stand-by state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has provided thereon a plurality of motors for driving the aforementioned drive rollers, each of the drive rollers being connected to one of the plurality of motors. The correspondence relation between the motors and the drive rollers will be described in detail below.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
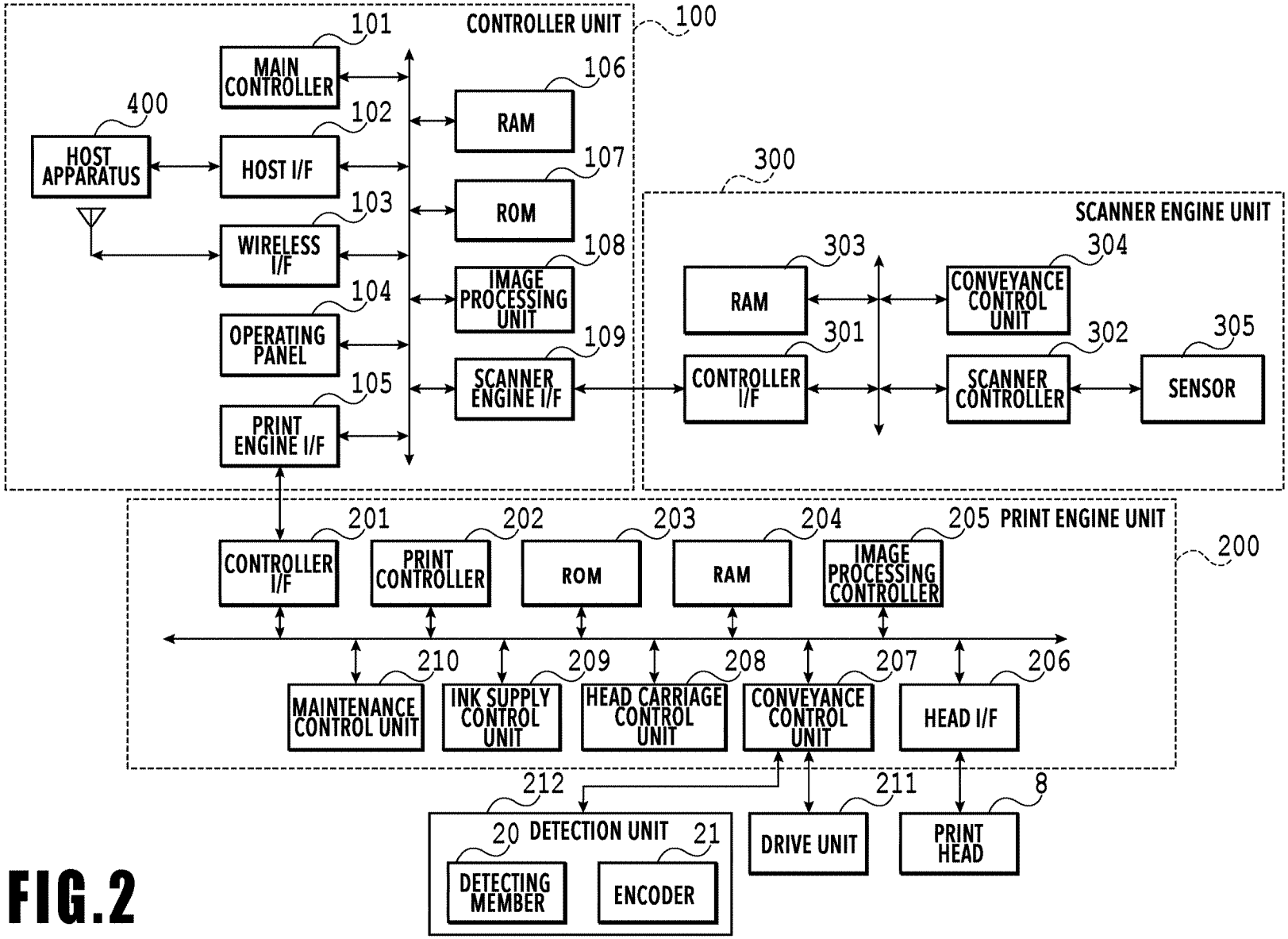
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller (control unit) 202 including a CPU controls various mechanisms of the print unit 2 using a RAM 204 as a work area in accordance with various programs and parameters stored in a ROM 203. Upon receiving various commands and image data via a controller I/F 201, the print controller 202 temporarily stores the commands and the image data in the RAM 204. The print controller 202 causes an image processing controller 205 to convert the stored image data into print data to allow the print head 8 to use the print data for a printing operation. Upon generating the print data, the print controller 202 causes the print head 8 to perform a printing operation on the basis of the print data via a head I/F 206. On this occasion, the print controller 202 drives the feeding units 6A and 6B, the conveying rollers 7, the discharging roller 12, and the flapper 11 illustrated in FIG. 1, via a conveyance control unit 207, and conveys the print medium S.

The conveyance control unit 207 is connected to a detection unit 212 configured to detect a conveyance state of the print medium S and a drive unit 211 configured to drive a plurality of drive rollers, and controls conveyance of the print medium S using the drive unit 211, on the basis of a detection result obtained from the detection unit 212. The detection unit 212 has detection members 20 configured to detect the presence or absence of the print medium S, and an encoder 21 configured to detect the amount of rotation of the drive rollers.

While the print medium S is being conveyed by the conveyance control unit 207, a printing operation is performed by the print head 8 according to an instruction from the print controller 202, and a printing process is performed.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller OF 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
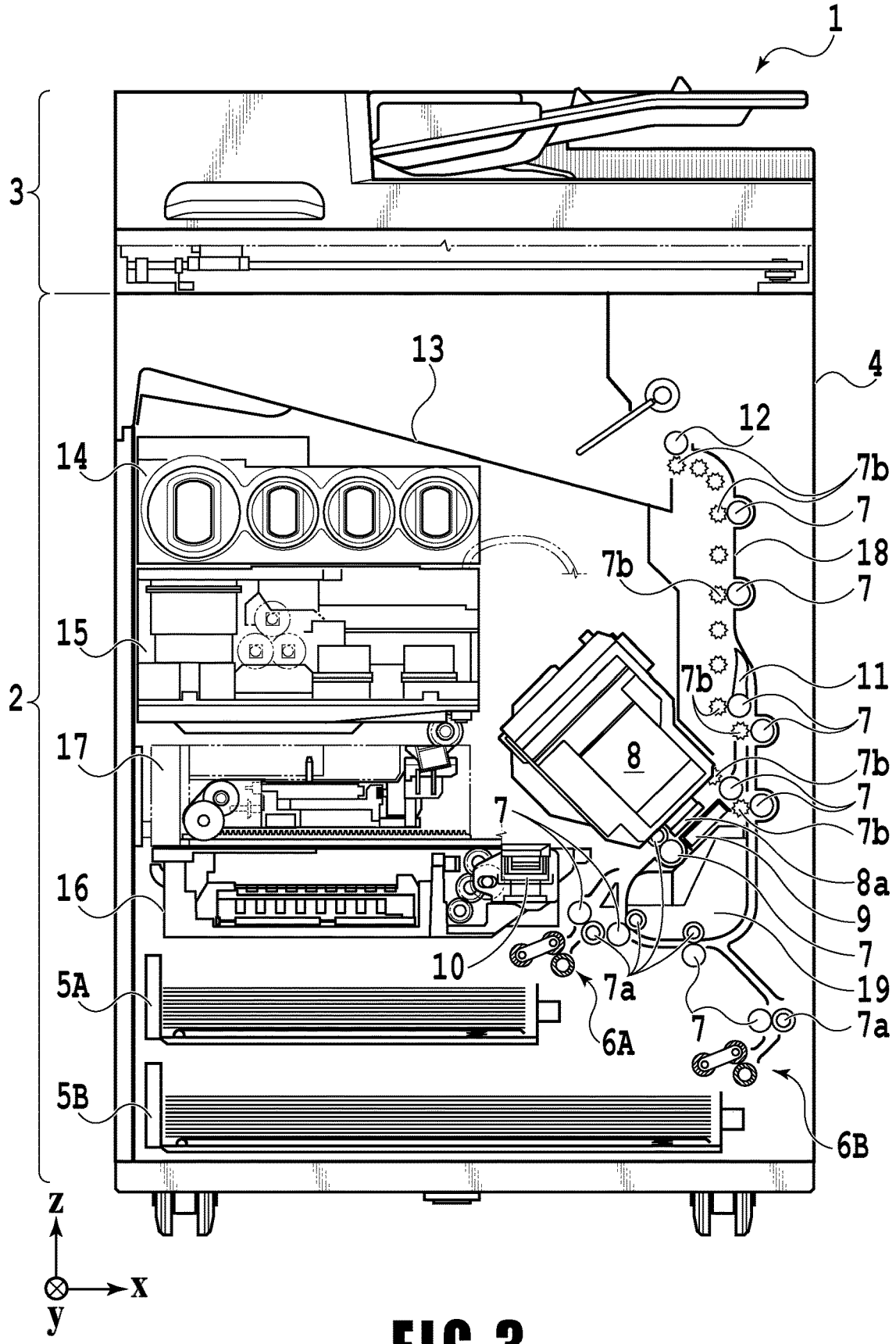
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
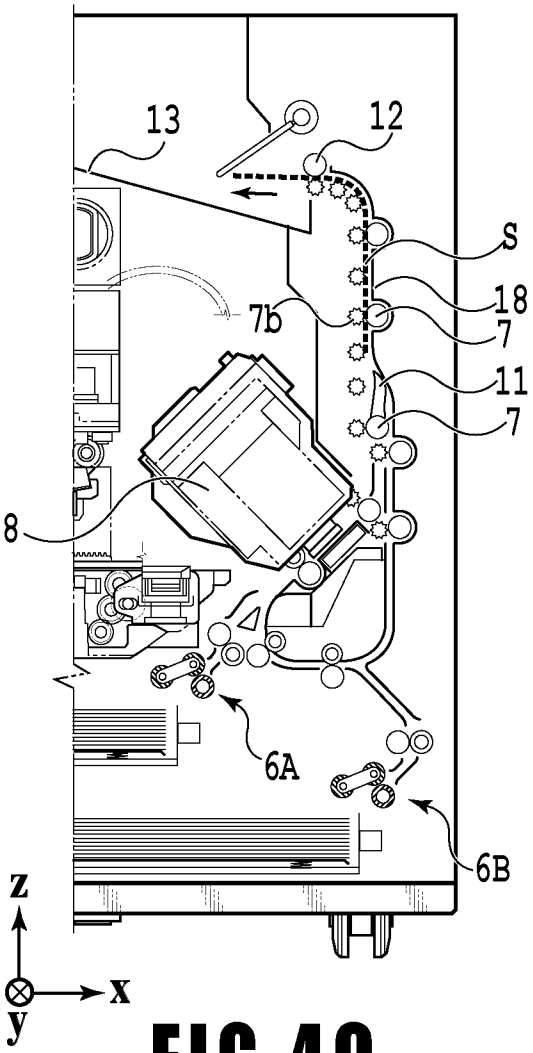
FIGS. 4A to 4C are conveying path diagrams of a print medium fed from a first cassette.
Figure 4B:
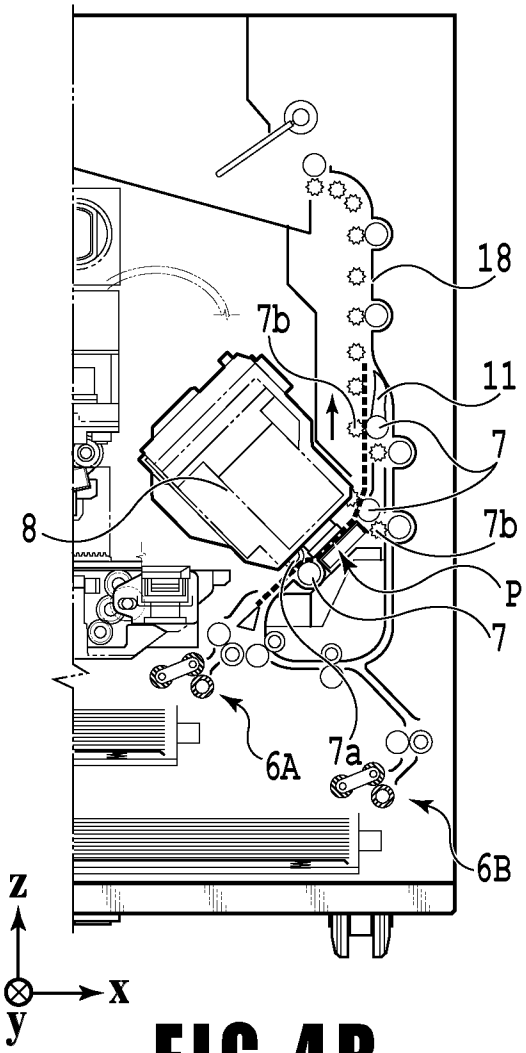
Figure 4A:
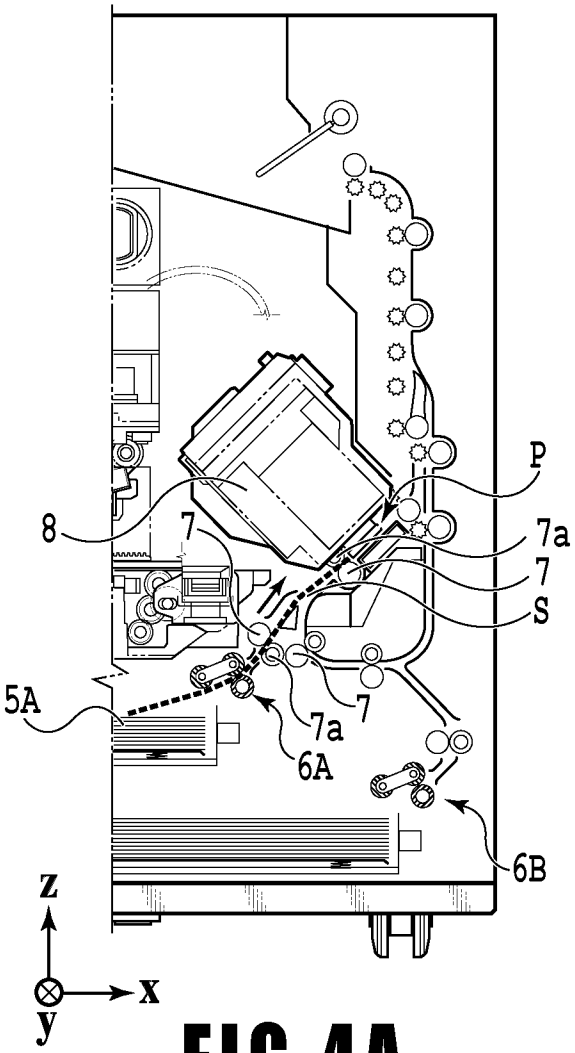

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 facing downward.

Figure 5C:
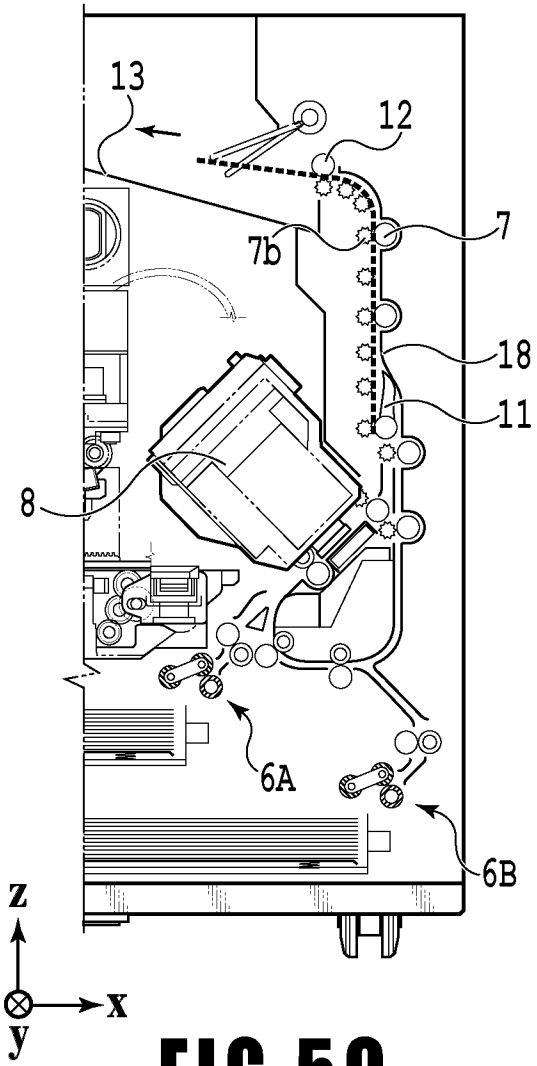
FIGS. 5A to 5C are conveying path diagrams of a print medium fed from a second cassette.
Figure 5B:
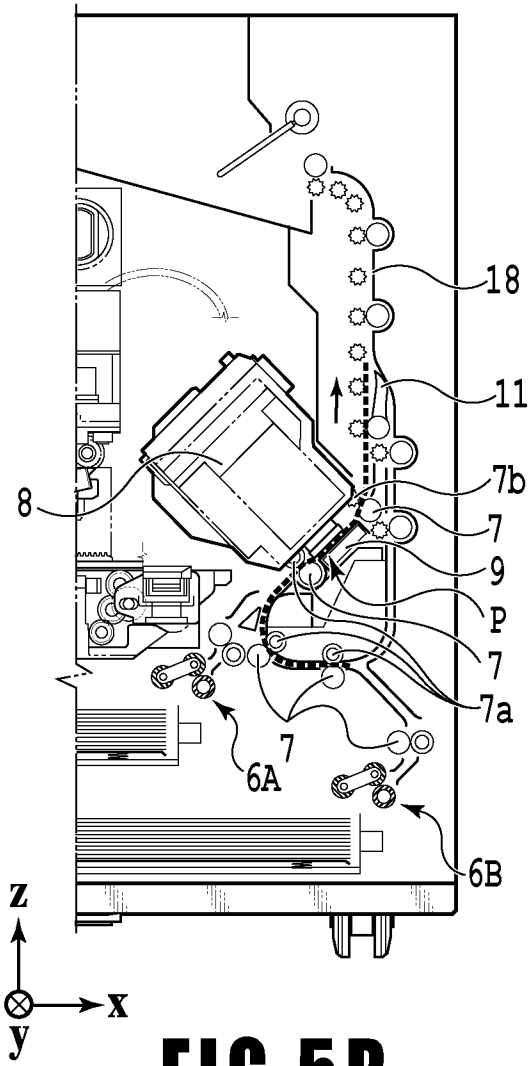
Figure 5A:
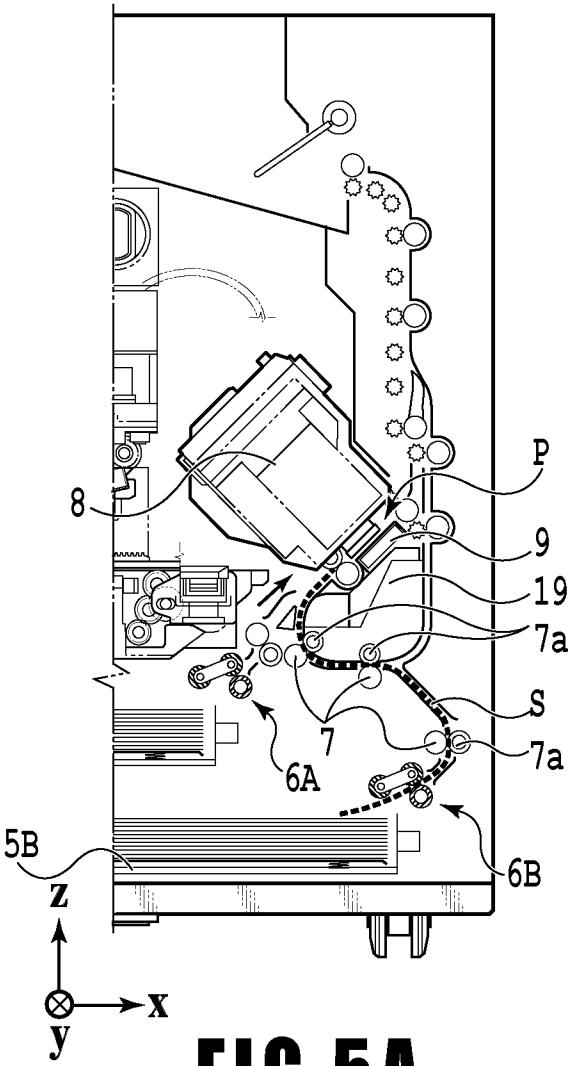

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of conveying the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
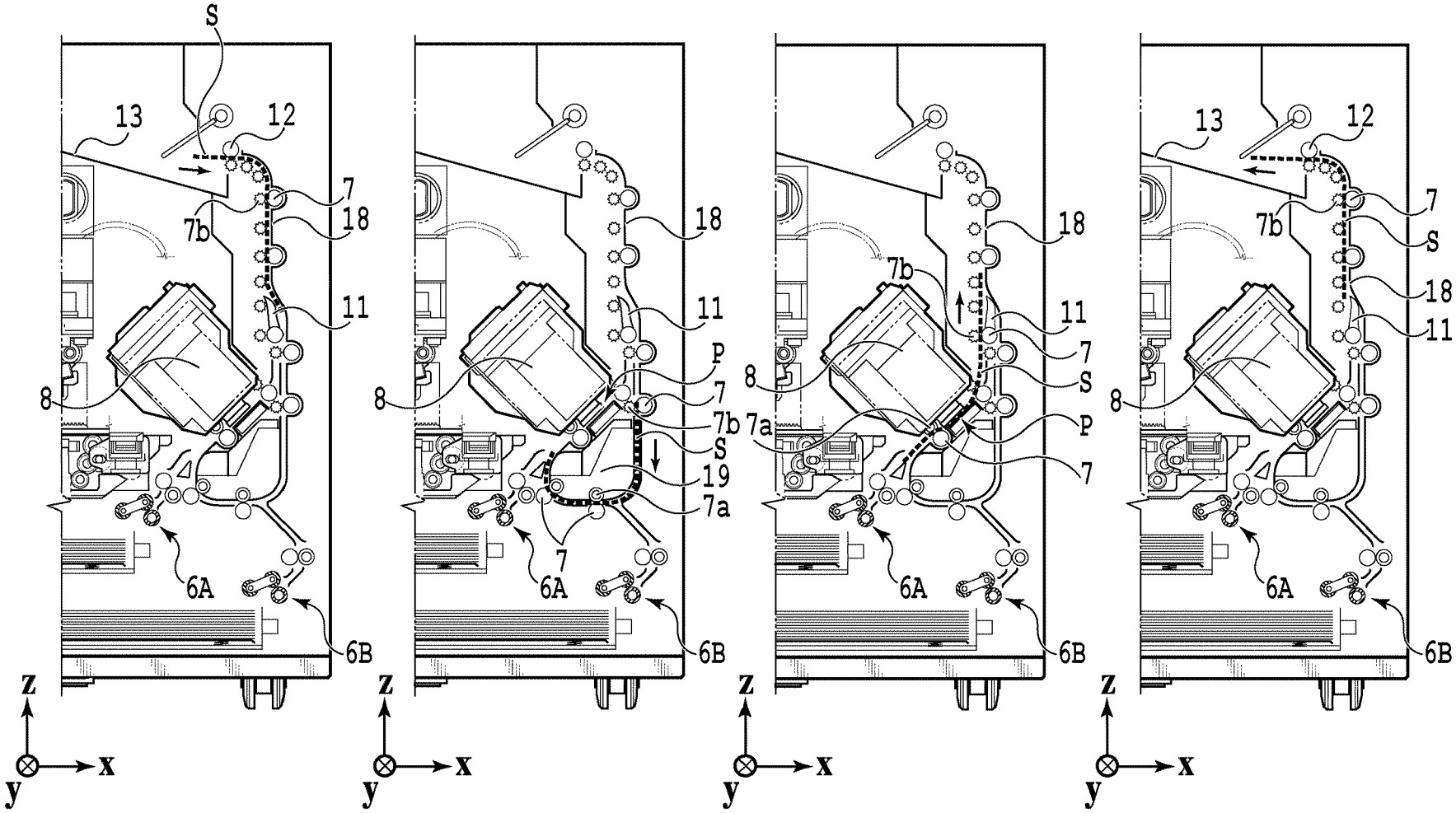
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
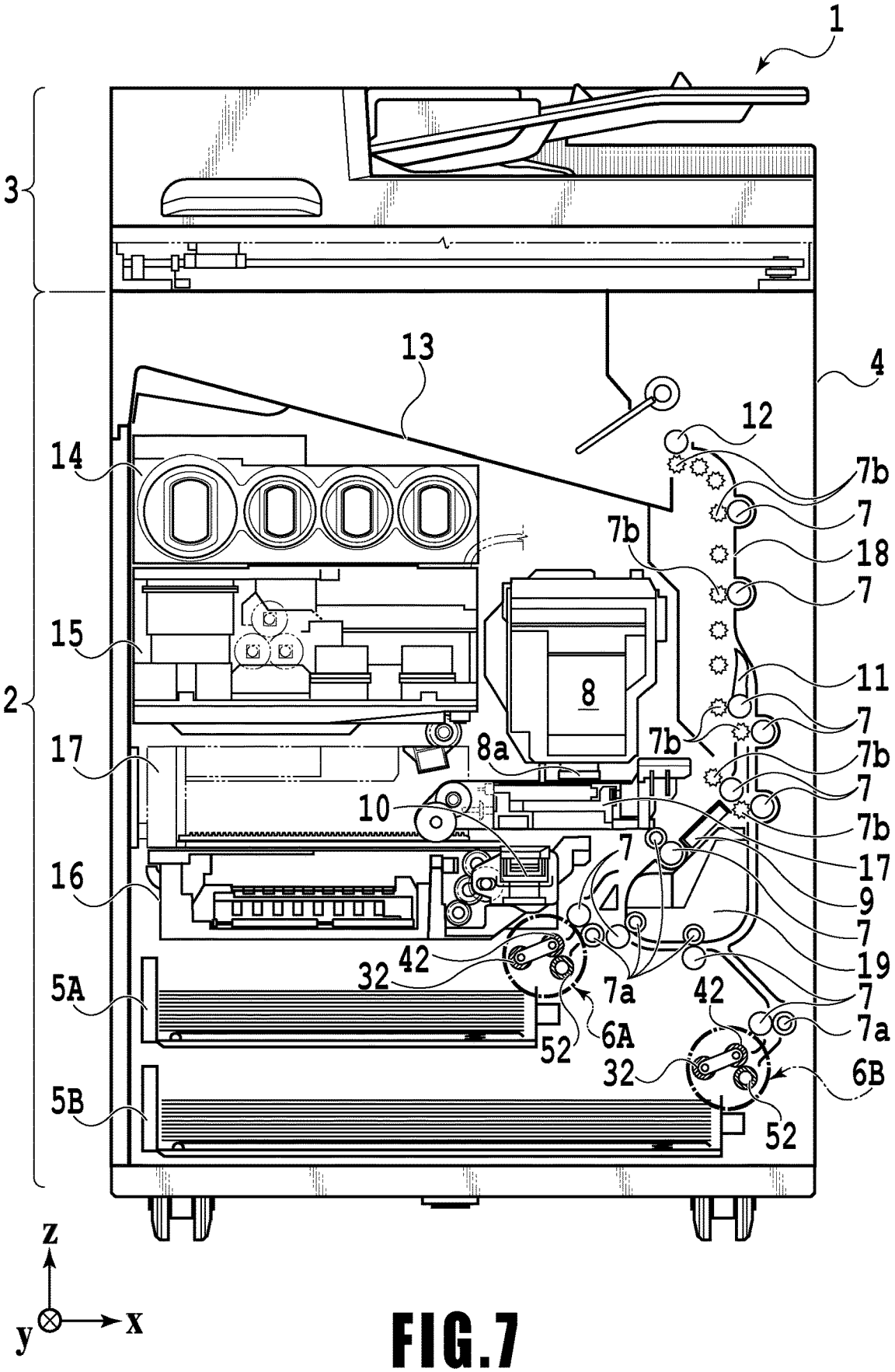
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8:
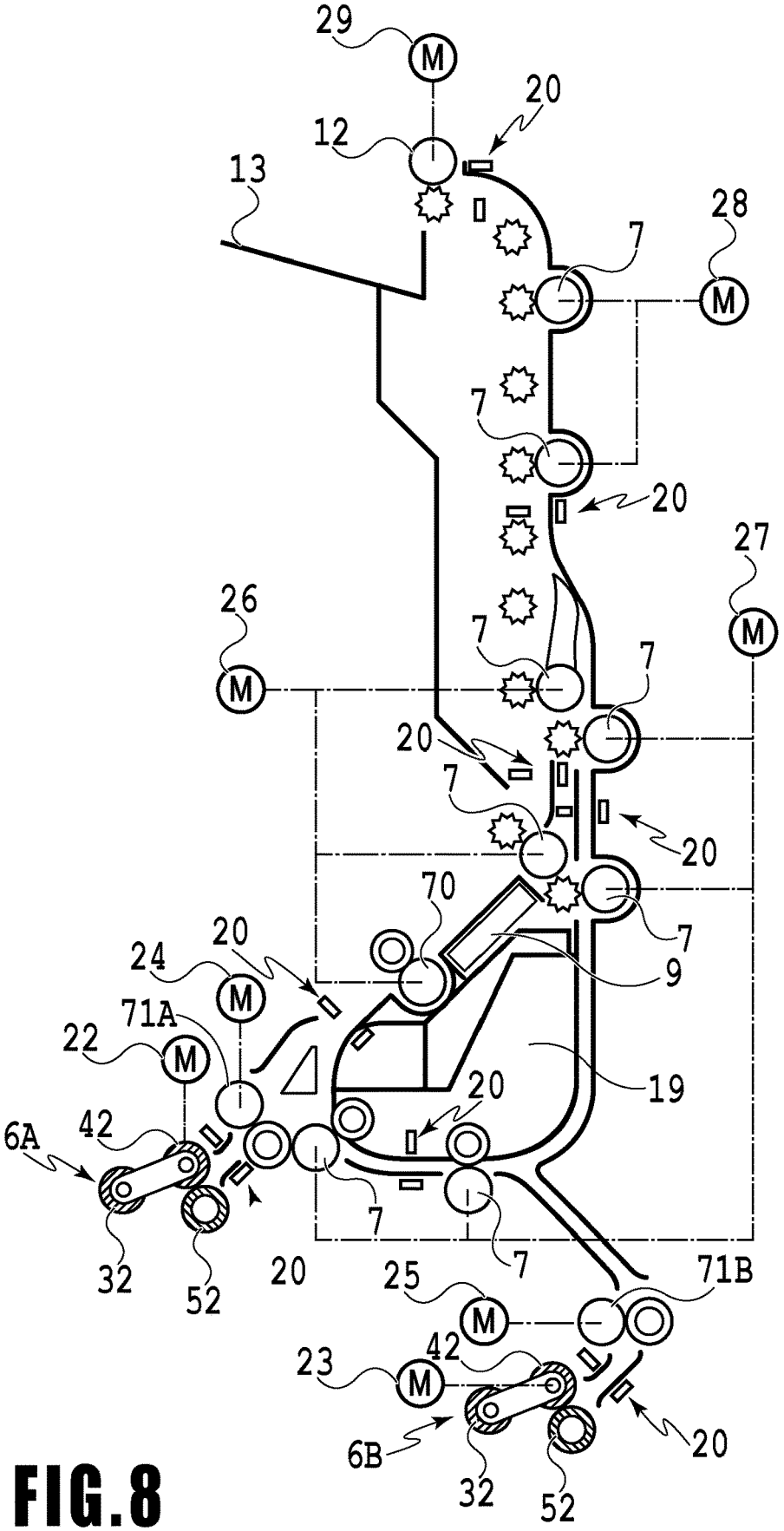
FIG. 8 illustrates a correspondence relation between a conveying roller and a motor.

FIG. 8 illustrates a correspondence relation between a plurality of motors and the drive rollers in the printing apparatus 1. A first feeding motor 22 drives a second roller shaft 40 described below, which is provided corresponding to the first feeding unit 6A for feeding the print medium S from the first cassette 5A. A second feeding motor 23 rotates a second roller shaft 40 described below, which is provided corresponding to the second feeding unit 6B for feeding the print medium S from the second cassette 5B. A first conveying motor 24 drives a first intermediate roller 71A which first conveys the print medium S fed by the first feeding unit 6A. A second conveying motor 25 drives a second intermediate roller 71B which first conveys the print medium S fed by the second feeding unit 6B.

A main conveying motor 26 drives a main conveying roller 70 provided upstream of the platen 9 to mainly convey the print medium S being subjected to printing. In addition, the main conveying motor 26 drives the two conveying rollers 7 provided downstream of the platen 9 to convey, further downstream, the print medium S being conveyed by the main conveying roller 70.

A third conveying motor 27 drives the two conveying rollers 7 which convey, downward, the print medium S subjected to printing on the first surface. In addition, the third conveying motor 27 also drives the two conveying rollers 7 provided along the inner guide 19. The two conveying rollers 7 convey, toward the print head 8, the print medium S fed from the second cassette 5B and conveyed by the second intermediate roller 71B, or the print medium S subjected to printing on the first surface and turned over.

A fourth conveying motor 28 drives the two conveying rollers 7 which convey the print medium S upward or downward, after being subjected to printing operation. A discharging motor 29 drives the discharging roller 12 which discharges the print medium S subjected to printing toward the discharging tray 13. As thus described, the two feeding motors 22 and 23, the five conveying motors 24 to 28, and the discharging motor 29 are respectively associated with one or more drive rollers.

On the other hand, the detection members 20 for detecting the presence or absence of the print medium S are provided at eight locations along the conveying path. Each of the detection members 20 includes a sensor and a mirror provided across the conveying path, with the sensor having a light emitting unit and a light receiving unit provided on one side of the conveying path, and the mirror provided on the other side of the conveying path at a position facing the sensor. According to whether or not the light-receiving unit detected light which has been emitted from the light emitting unit of the sensor and reflected by the mirror, the presence or absence of the print medium S, i.e., the passage of the front end or back end, is determined.

The conveyance control unit 207 drives the feeding motors 22 and 23, the conveying motors 24 to 28, and the discharging motor 29, individually, on the basis of respective detective results of the plurality of detection members 20, and an output value of an encoder configured to detect the amount of rotation of each drive roller, and controls conveyance in the apparatus as a whole.

Here, the configuration and function of the feeding unit of the present embodiment will be described in more detail. The feeding apparatus in the present embodiment is configured to include a feeding cassette that serves as a stacking part stacking print media and a feeding unit that feeds the print media from the feeding cassette to a conveying path. As has been described above, the present embodiment has, as the stacking part, the first cassette 5A and the second cassette 5B provided on two decks, namely, an upper deck and a lower deck. The first feeding unit 6A is provided in the vicinity of the first cassette 5A, and the second feeding unit 6B is provided in the vicinity of the second cassette 5B, respectively. The first feeding unit 6A provided in the vicinity of the first cassette 5A and the second feeding unit 6B provided in the vicinity of the second cassette 5B have a similar configuration except for the difference in the largest size of the print medium S that may be fed. Therefore, in the following, description will be provided taking as an example the first feeding apparatus 61 including the first cassette 5A and the first feeding unit 6A illustrated in FIG. 9.

Figure 9:
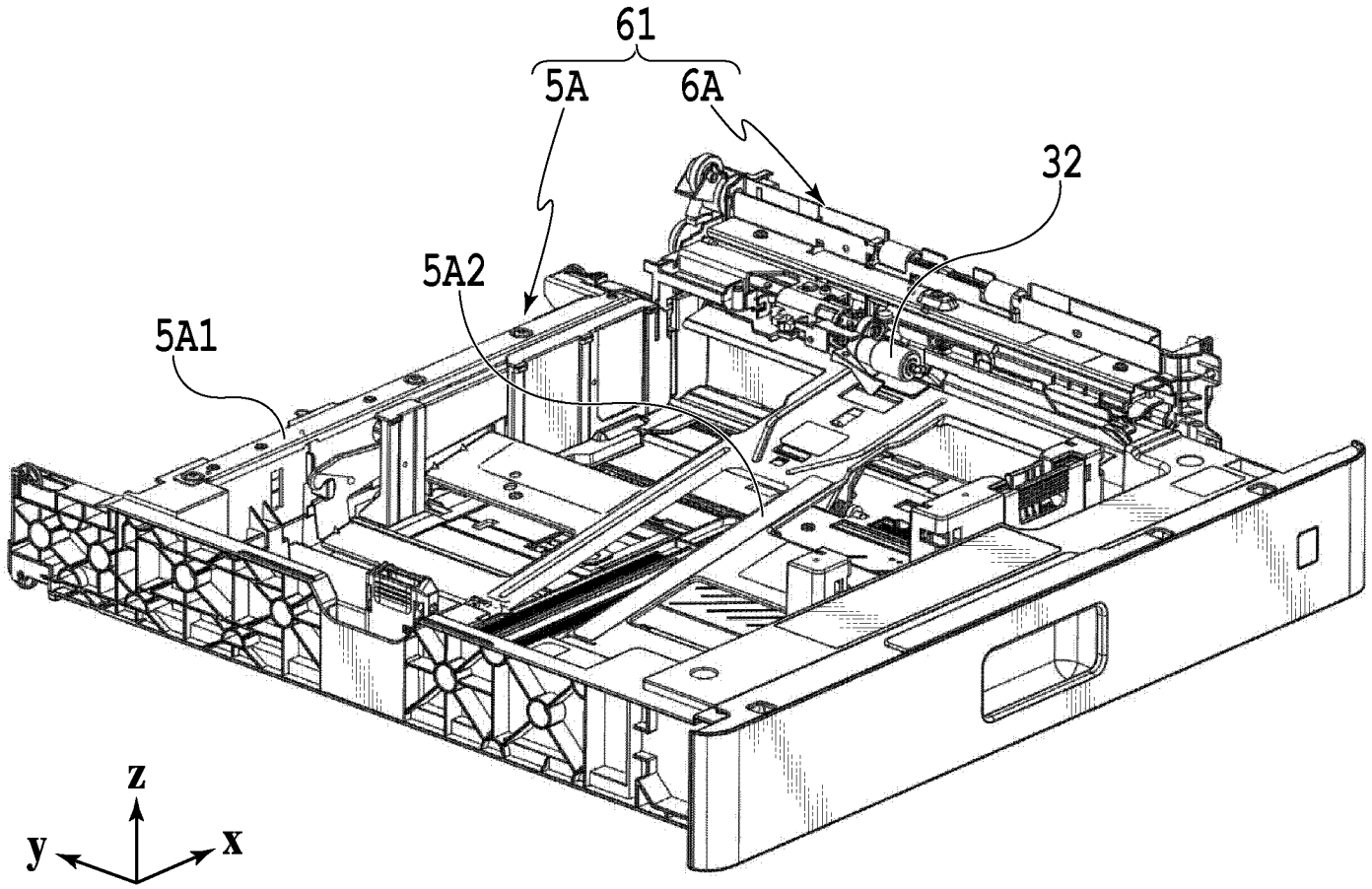
FIG. 9 is a perspective view illustrating a configuration of the feeding unit 6A illustrated in FIG. 1 and a stacking part capable of stacking print media.

As illustrated in FIG. 9, the first cassette 5A has a rectangular box-shaped cassette main body 5A1 which is open at the upper side and has provided therein a pressure plate 5A2 supporting the print medium from below. The pressure plate 5A2 is biased upward by a spring which is not illustrated. In addition, the first feeding unit 6A is provided in the vicinity of the upper part of one side of the cassette main body 5A1.

Figure 10:
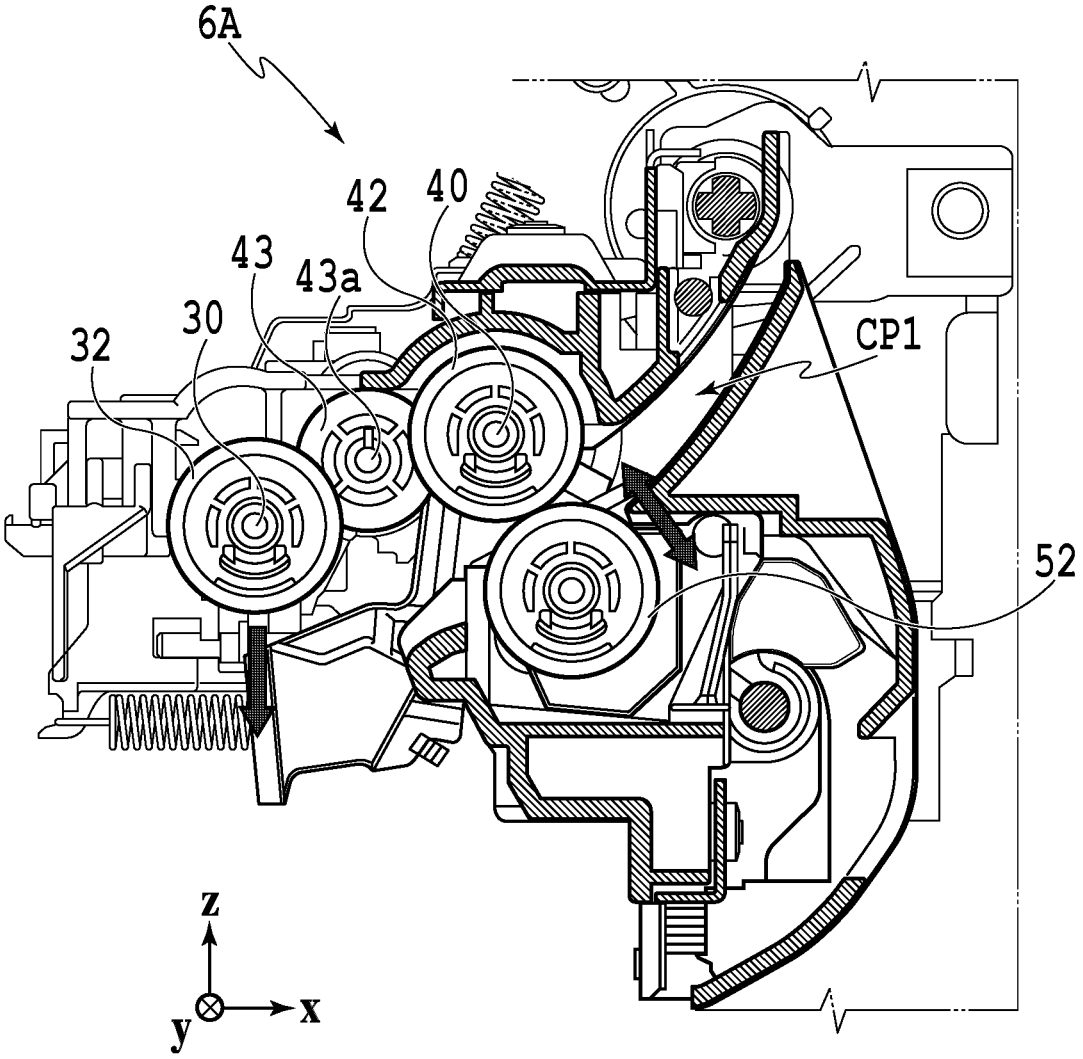
FIG. 10 is a cross-sectional view of the feeding unit 6A.
Figure 11:
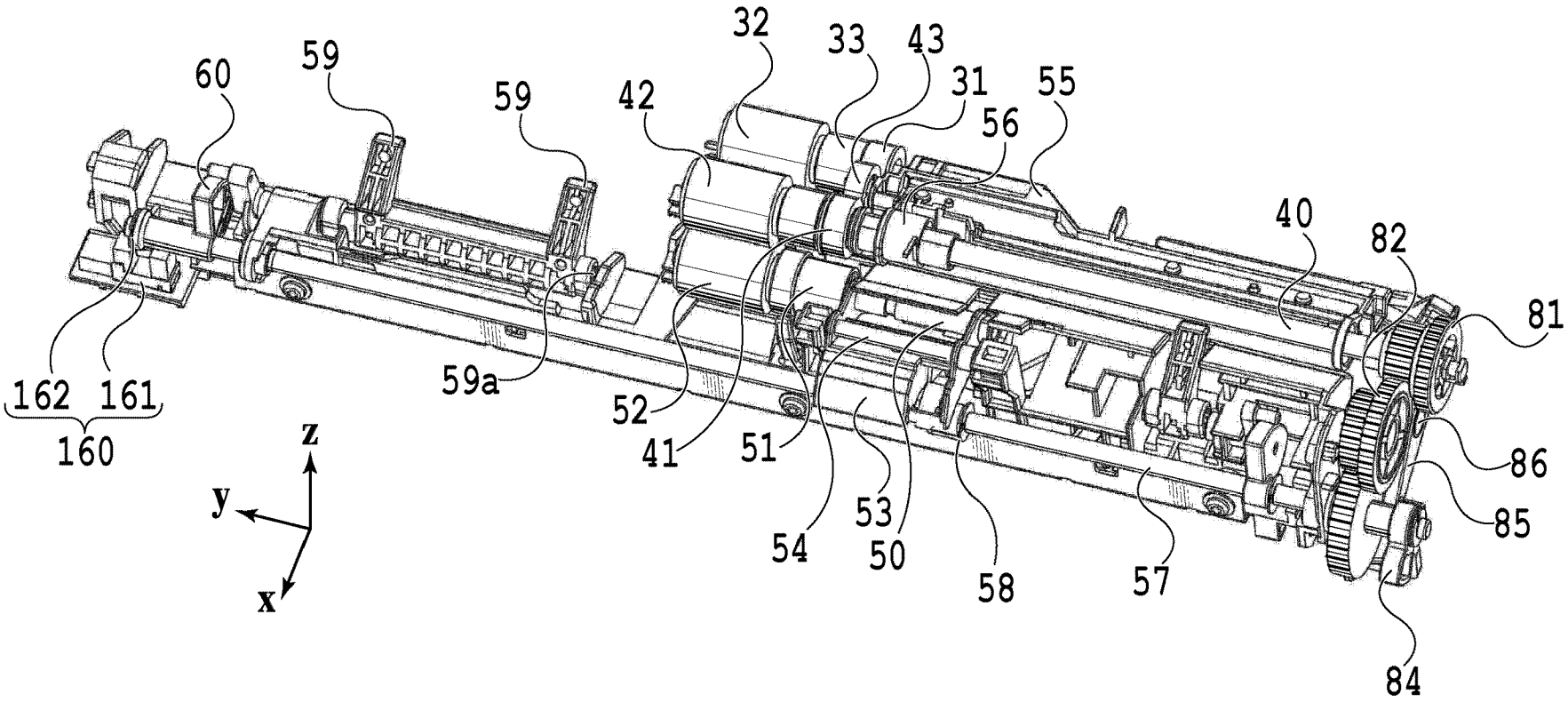
FIG. 11 is a perspective view of respective rollers of the feeding unit seen diagonally from the top right of FIG. 9.
Figure 12:
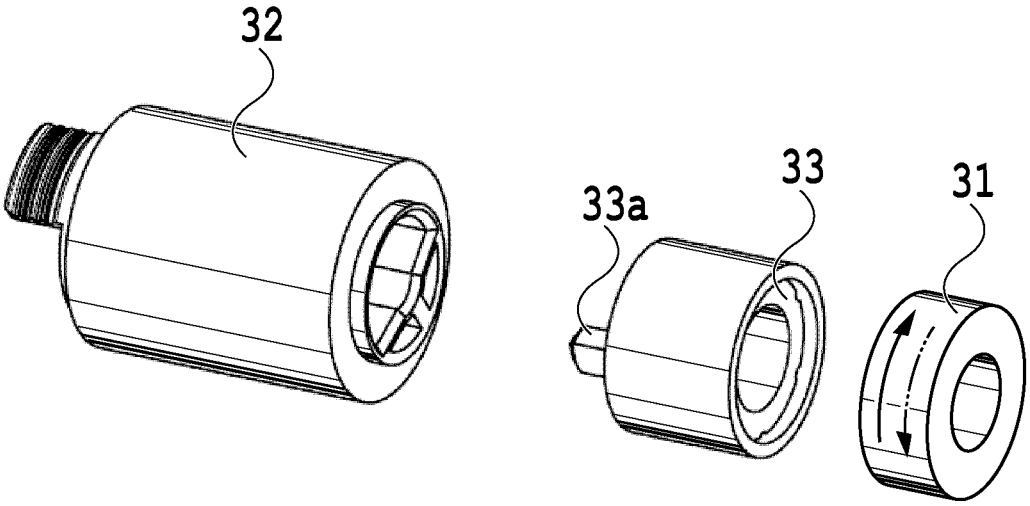
FIG. 12 is a perspective view illustrating a one-way clutch and a first feeding roller illustrated in FIG. 11.
Figure 13:
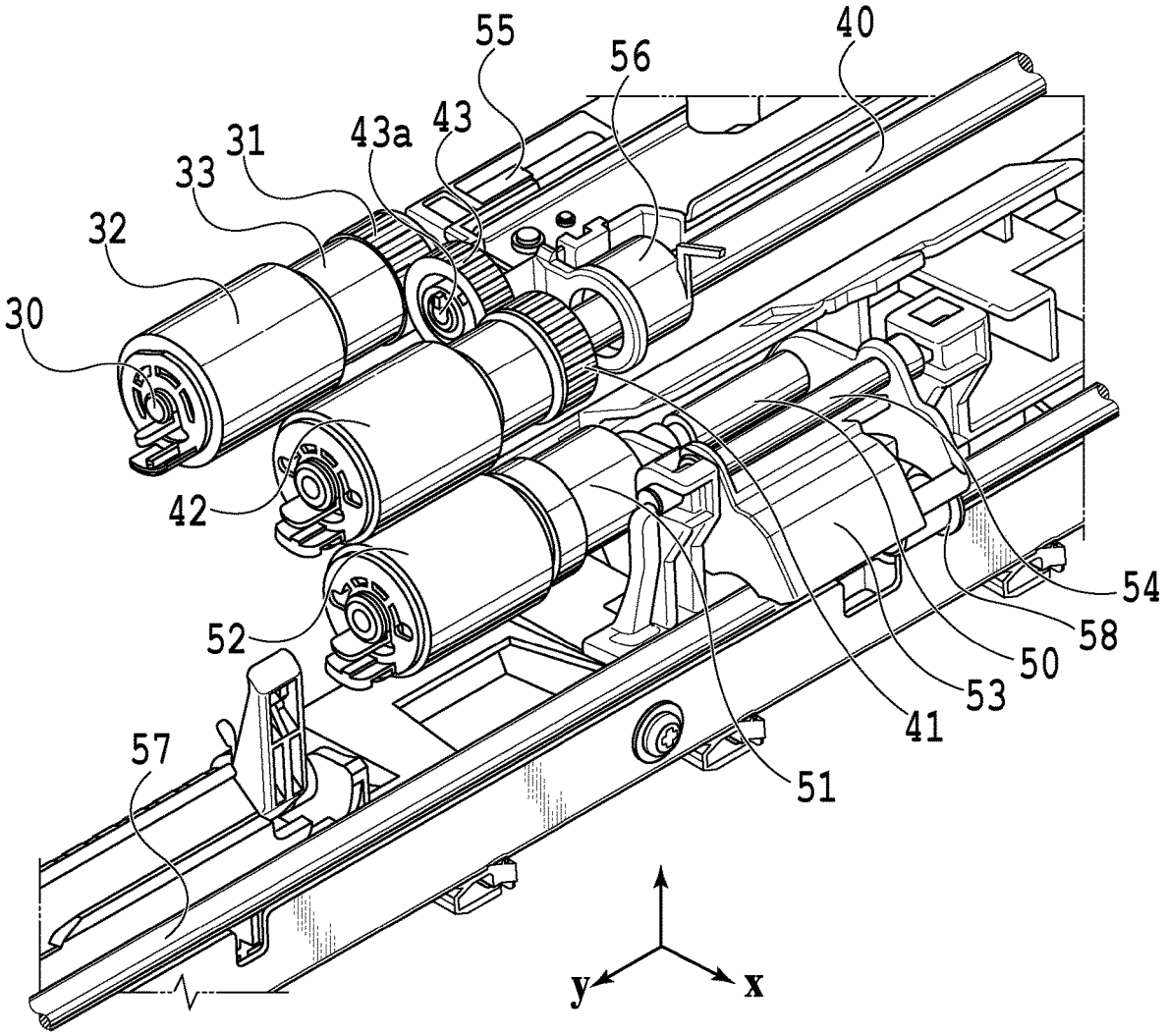
FIG. 13 is a perspective view of respective rollers of the feeding unit 6A.

FIG. 10 is a cross-sectional view illustrating in more detail the configuration of the feeding unit 6A illustrated in FIG. 1, FIG. 11 is a perspective view illustrating the arrangement of respective rollers of the feeding unit 6A, and FIG. 12 is a perspective view illustrating a one-way clutch 33 and a first feeding roller 32 illustrated in FIG. 11. In addition, FIG. 13 is a perspective view in which the first feeding unit 6A is seen from a direction different to that of FIG. 11.

In FIGS. 10 to 13, the first feeding unit 6A is intended to feed the print media one by one from the first cassette 5A. The first feeding unit 6A is configured to include the first feeding roller 32, a second feeding roller 42, a separation roller (separation member) 52, a first roller gear 31, an idle roller gear 43, and a second roller gear 41, or the like. The first feeding roller (pickup roller) 32 is rotatably supported by the first roller shaft 30, and configured to be movable between an abutting position at which the first feeding roller 32 abuts the top surface of print media S housed in the first feeding cassette 5A (see FIG. 1) and a separated position away from the print medium S. The movement is performed by a feeding roller movement unit described below.

The one-way clutch 33 and the first roller gear 31 are provided on the center shaft and the shaft line of a first feeding roller shaft 30 extending in the y-direction of the first feeding roller 32. The one-way clutch 33 rotates integrally with the first roller gear 31 in the case where the first roller gear 31 rotates in a forward rotation direction (the direction indicated by the solid line arrow in FIG. 12). In addition, in the case where the first roller gear 31 rotates in a reverse direction (the direction indicated by the dot-and-dash line arrow in FIG. 12), rotation force of the first roller gear 31 is not transmitted to the one-way clutch 33.

Furthermore, the one-way clutch 33 and the first feeding roller 32 are coupled via a predetermined delay mechanism. In other words, the rotation force of the one-way clutch 33 is configured not to be transmitted to the first feeding roller 32 until the one-way clutch 33 rotates from an initial position to a predetermined phase. Specifically, the one-way clutch 33 has formed thereon a protrusion 33*a* to be inserted into the first feeding roller 32, and engagement of the protrusion 33*a* and the inner wall of the first feeding roller 32 causes transmission of the rotation force. In other words, upon rotating from an initial position to a predetermined phase position, the protrusion 33*a* engages with the inner wall of the first feeding roller 32, and subsequently the rotation force of the one-way clutch 33 is transmitted to the first feeding roller 32. In other words, until the protrusion 33*a* of the one-way clutch 33 reaches from an initial position to a predetermined phase, the rotation force of the one-way clutch 33 is not transmitted to the first feeding roller 32.

Note that, the forward rotation direction in the present specification refers to the rotation direction of each roller in the case where a print medium is fed from the first feeding cassette 5A toward the print head, whereas the reverse direction refers to a direction of rotation in a reverse direction relative to the forward rotation direction.

The second feeding roller 42 is fixed to the second roller shaft 40 extending in the y-direction. The second roller shaft 40 is a drive shaft rotating with the aforementioned first feeding motor (feeding roller drive unit) 22 serving as the driving source. The second feeding roller 42 and the second roller gear 41 rotate integrally with the second roller shaft 40. Rotation of the second roller gear 41 is transmitted to the first roller gear 31 and the one-way clutch 33 via the idle roller gear 43. On this occasion, in the case where the rotation direction of the first roller gear 31 is the forward rotation direction, rotation of the first roller gear 31 is transmitted from the one-way clutch 33 to the first feeding roller 32 after a delay period described below, and the first feeding roller 32 rotates in the forward rotation direction. In contrast, rotation of the first roller gear 31 in the reverse direction is not transmitted to the first feeding roller 32 due to action of the one-way clutch 33.

The first roller shaft 30 supporting the first roller gear 31 and a center-of-rotation shaft 43*a* supporting idle roller gear 43 are both supported by a feeding roller holding member 55 rotatably in forward and reverse directions. The feeding roller holding member 55 is supported in a freely rotatable manner about the second roller shaft 40 via a sliding bearing or the like, and biased so as to rotate downward by a roller biasing spring 56 ((feeding roller biasing member) biasing unit) that biases the feeding roller holding member 55. In addition, the feeding roller holding member 55 is configured to abut a feeding roller movement cam 84 that rotates together with a camshaft 57, and also rotate around the second roller shaft 40, by a feeding roller movement lever 85 that allows rotation of the feeding roller holding member 55. The camshaft 57 rotates in conjunction with the second roller shaft 40, due to a power transmission mechanism described below.

The feeding roller movement cam 84 rotating together with the camshaft 57 causes the movement lever 85 to abut and depress the feeding roller holding member 55, and the feeding roller holding member 55 is caused to rotate upward around the second roller shaft 40. Accordingly, the first feeding roller 32 moves to a separated position separated upward from the print media S housed in the first cassette 5A.

Upon the camshaft 57 rotating further, the movement lever 85 separates from the abutting position against the feeding roller holding member 55 by the feeding roller movement cam 84. As a result, the feeding roller holding member 55 moves downward around the second roller shaft 40 due to the biasing force of the roller biasing spring 56, and the first feeding roller 32 abuts the top surface (first surface) of the print media S housed in the first cassette 5A.

A separation roller 52 is rotatably supported by a fixed center shaft 50 provided for a separation roller holding member 53 via a torque limiter 51. The separation roller holding member 53 is rotatably supported by a spindle 54 held by a frame, and performs a movement operation around the spindle 54, due to cooperation of a separation roller cam (separation member movement cam) 58 fixed to the camshaft 57 and a biasing spring which is not illustrated. Rotationally moving the separation roller holding member 53 causes the separation roller 52 to be selectively located at a nipping position at which the print medium S is nipped between the separation roller 52 and the second feeding roller 42, and a non-contact position at which the separation roller 52 separates from the second feeding roller 42 and does not contact the print medium. The position (nipping position) at which the print medium S is nipped between the separation roller 52 and the second feeding roller 42 is defined in the vicinity of the entrance of a conveying path CP1 (see FIG. 10) within the feeding unit. The print medium S being nipped between the second feeding roller 42 and the separation roller 52 is sent into the conveying path CP1 by rotation of the second feeding roller 42. The separation roller 52 is coupled to the torque limiter 51, which provides resistance force against the rotation of the separation roller 52. Accordingly, in the case where a plurality of sheets of the print media S are sent between the second feeding roller 42 and the separation roller 52, only one sheet of the print media contacting the second feeding roller 42 is fed downstream, and feeding of the print media other than the aforementioned print medium is prevented due to contact with the separation roller. In other words, only the top sheet of the print media is fed downstream.

In addition, there is provided a return member 59 in the vicinity of the entrance of the conveying path CP1 for returning the print medium S remaining in the vicinity thereof to the first cassette 5A. The return member 59 is configured to pivot with a rotating shaft 59*a* being at the center, due to a return member cam 60 (see FIG. 11) that rotates along with rotation of the camshaft 57. In other words, the return member 59 moves in the backward direction due to the return member cam 60 in the case of conveying the print medium S downstream along the conveying path CP1, and retracts to a retracted position separated from the conveying path CP1. Therefore, blocking of conveyance due to the front edge of the print medium S being conveyed downstream and interfering with the return member 59 is prevented.

Figure 15:
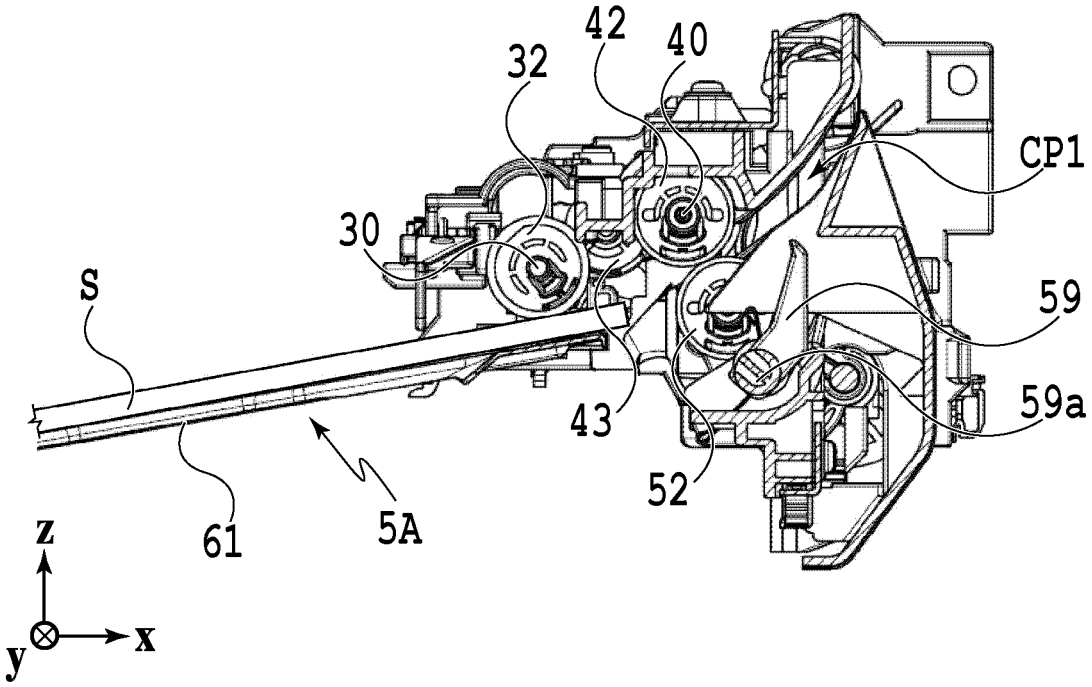
FIG. 15 is a cross-sectional view illustrating an initial state in the feeding apparatus.

Additionally, in the case of returning the sheets of the print media S remaining in the conveying path CP1 to the first cassette 5A, the return member 59 rotates from the retracted position and moves in the forward direction around the rotating shaft 59*a* (see FIG. 15). The movement in the forward direction causes the return member 59 to abut the front edge of the sheets of the print media S remaining in the conveying path CP1 and return the print media S to the first cassette 5A.

Figure 14:
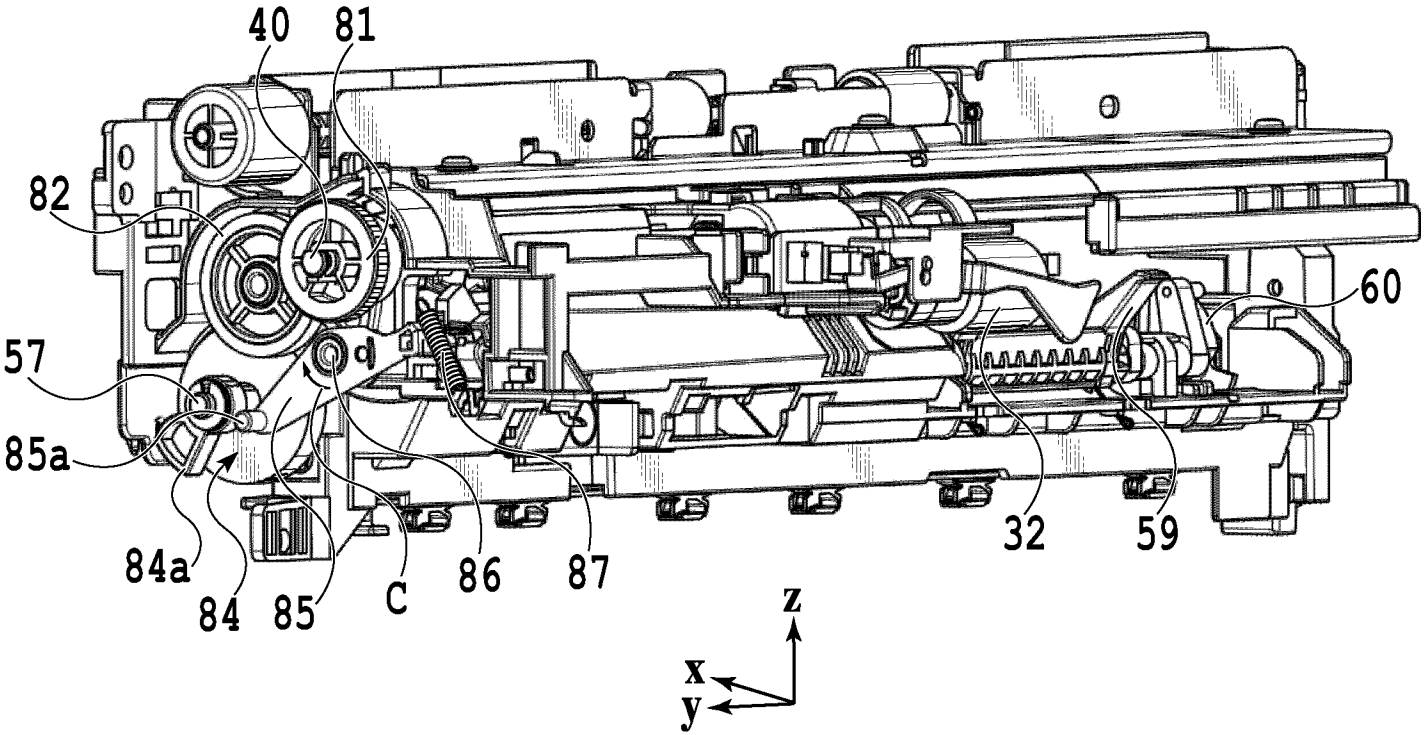
FIG. 14 is a front view illustrating in more detail the configuration of the feeding unit 6A illustrated in FIG. 1.

FIG. 14 is a perspective view illustrating the power transmission mechanism that transmits rotation force of the second roller shaft 40 being rotated by the first feeding motor 22 to the camshaft 57. An input gear 81 is fixed to the end of the second roller shaft 40. The rotation force of the input gear 81 is transmitted to the feeding roller movement cam 84 via an idle gear 82. The feeding roller movement cam 84 is fixed to the camshaft 57 and rotates together with the camshaft 57.

The feeding roller movement lever 85 is supported in a freely rotatable manner by a spindle 86 and biased toward a predetermined direction (direction C in FIG. 14) by a biasing spring 87. The biasing force of the biasing spring 87 causes one end 85*a* of the feeding roller movement lever 85 to constantly abut the feeding roller movement cam 84. In addition, the feeding roller movement lever 85 is coupled to the aforementioned feeding roller holding member 55.

Upon the feeding roller movement cam 84 rotating to a predetermined phase, a depression part 84*a* of the feeding roller movement cam 84 depresses the one end 85*a* of the feeding roller movement lever 85, and causes the feeding roller movement lever 85 to rotate in a direction reverse to the direction C against the biasing spring 87. In conjunction with the rotation of the feeding roller movement lever 85, the feeding roller holding member 55 rotates around the second roller shaft 40. As a result, the first feeding roller 32 supported by the feeding roller holding member 55 is held at separated position away from the print media S stacked on the first cassette 5A.

Upon the camshaft 57 further rotating in conjunction with the second roller shaft 40 from a state where the first feeding roller 32 is held at the separation position, the depression part 84*a* of the feeding roller movement cam 84 separates from the one end 85*a* of the feeding roller movement lever 85. As a result, the feeding roller movement lever 85 rotates due to the biasing force of the biasing spring 87 and, in conjunction therewith, the feeding roller holding member 55 rotates downward around the second roller shaft 40. The rotation of the feeding roller holding member 55 causes the first feeding roller 32 to move to the abutting position at which it abuts the top sheet of the print media S in the first cassette 5A.

Note that the feeding roller movement unit that moves the first feeding roller 32 to the abutting position against and the separated position from the print media includes the feeding roller holding member 55, and a holding member movement unit configured to move the feeding roller holding member 55 reciprocally relative to a predetermined fulcrum (the second roller shaft 40). The holding member movement unit is configured to include the camshaft 57, the feeding roller movement cam 84, the roller biasing spring 56, the feeding motor 22, and the aforementioned power transmission mechanism or the like.

A separation roller movement unit (separation member movement unit) that moves the separation roller 52 to the contact position (nipping position) and the retracted position relative to the second feeding roller 42 includes the separation roller holding member 53, the camshaft 57, a separation roller cam 58, the feeding motor 22, and the power transmission mechanism.

Figure 16A:
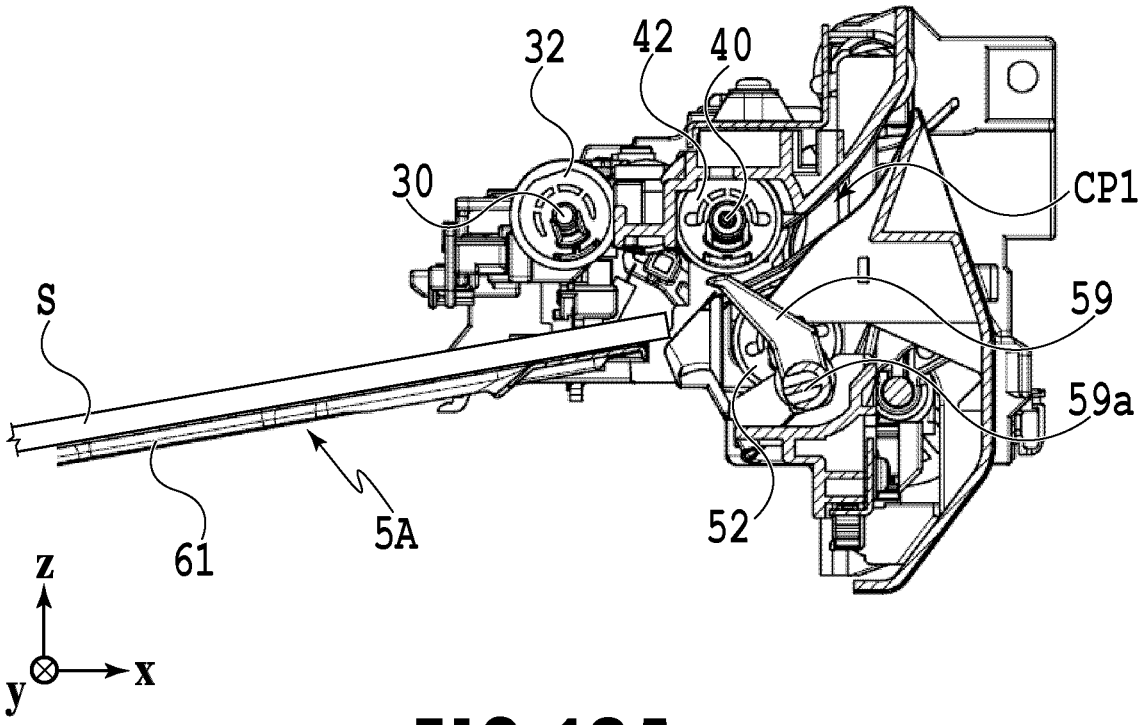
FIGS. 16A and 16B are cross-sectional views illustrating a series of feeding operations in the feeding apparatus.

In the foregoing description, the configuration of the first feeding unit 6A has been explained, and since the second feeding unit 6B that feeds the print media from the second feeding cassette 5B has a similar configuration, explanation relating to the second feeding unit will be omitted here. Next, a feeding operation performed by the first feeding unit having the aforementioned configuration will be described, referring to FIGS. 15 and 16. FIG. 15 illustrates a stand-by state before starting the feeding operation. In the stand-by state before a printing instruction is transmitted from the host device 400 to the controller unit 100, the conveyance control unit 207 of the print engine unit 200 controls the feeding motor 22 serving as the driving source of the first feeding unit 6A, and keeps respective parts at an initial state. In the initial state, as illustrated in FIG. 15, the first feeding roller 32 abuts the top surface (first surface) of the top sheet of the print media S housed in the first cassette 5A. In other words, the feeding roller holding member 55 is biased downward by a biasing force of the aforementioned roller biasing spring 56, the first feeding roller 32 contacting the top surface of the top sheet of the print media S with a moderate biasing force. Additionally, in the initial state, the return member 59 is held at a retracted position at which the conveying path CP1 is released, and the separation roller 52 is held at the abutting position against the second feeding roller 42, respectively.

Upon input of a printing instruction from the host device 400 to the controller unit 100, a control signal is transmitted from the controller unit 100 to the print engine unit 200. Upon receiving the control signal, the print controller 202 of the print engine unit 200 drives the feeding motor 22 via the conveyance control unit 207, and causes the second roller shaft 40 to rotate.

The rotation force of the second roller shaft 40 is transmitted to the one-way clutch 33 via second roller gear 41, the idle roller gear 43, and the first roller gear 31. There is provided a delay mechanism intervening between the one-way clutch 33 and the first feeding roller 32, and the rotation force of the one-way clutch 33 is not transmitted to the first feeding roller 32 until a predetermined phase is reached after the one-way clutch 33 has started rotation. In other words, even in the case where rotation of the second roller shaft 40 has been started, the first feeding roller 32 does not immediately rotate but starts rotating after the predetermined delay period (the period indicated by a in FIG. 17) has elapsed.

As thus described, setting the delay period between the start of rotation of the second roller shaft 40 and the start of rotation of the first feeding roller 32 makes it possible to move each member being in the stand-by state to a position suitable for feeding the print medium S during the delay period. For example, it becomes possible to perform a preparation operation for causing the torque limiter 51 to generate a desired torque during the delay period.

Upon elapse of the delay period, the first feeding roller 32 starts rotating by rotation of the one-way clutch 33. The first feeding roller 32 is in a state contacting the top surface of the print media S already housed in the first cassette 5A at the stage of the stand-by state. Therefore, the print media S may be sent out from the first cassette 5A along with rotation of the first feeding roller 32. On this occasion, there may occur the so-called double-feed, in which the top print medium S contacting the first feeding roller 32 and the print media S thereunder are sent out from the first cassette 5A in an overlapped manner. However, the double-fed print media S are nipped between the second feeding roller 42 and the separation roller 52 so as to be separated into the top sheet and sheets thereunder of the print media S.

Upon conveying the top sheet of the print media S to downstream of the separation roller 52 in the conveying direction by the conveying roller 7, the return member 59 starts moving from the retracted position into the conveying path CP1. On this occasion, the feeding roller holding member 55 moves upward so as to allow the return member 59 to return the remaining print media S into the first cassette 5A, and the separation roller 52 separates from the second feeding roller 42. Upon the return member 59 finally reaching the return position illustrated in FIG. 16A, the feeding roller holding member 55 moves downward.

After the return member 59 has completed returning of the print media S, the first feeding roller 32 abuts (descends to) the top surface of the top sheet of the print media S housed in the first feeding cassette 5A due to the biasing force of the roller biasing spring 56. On this occasion, the feeding motor serving as the driving source of the second roller shaft 40 is in a terminate state, and rotation of the first feeding roller 32 has been terminated. Accordingly, the print medium is not fed from the first cassette 5A to the nipping position between the second feeding roller 42 and the separation roller 52, preventing occurrence of double-feed.

Figure 16B:
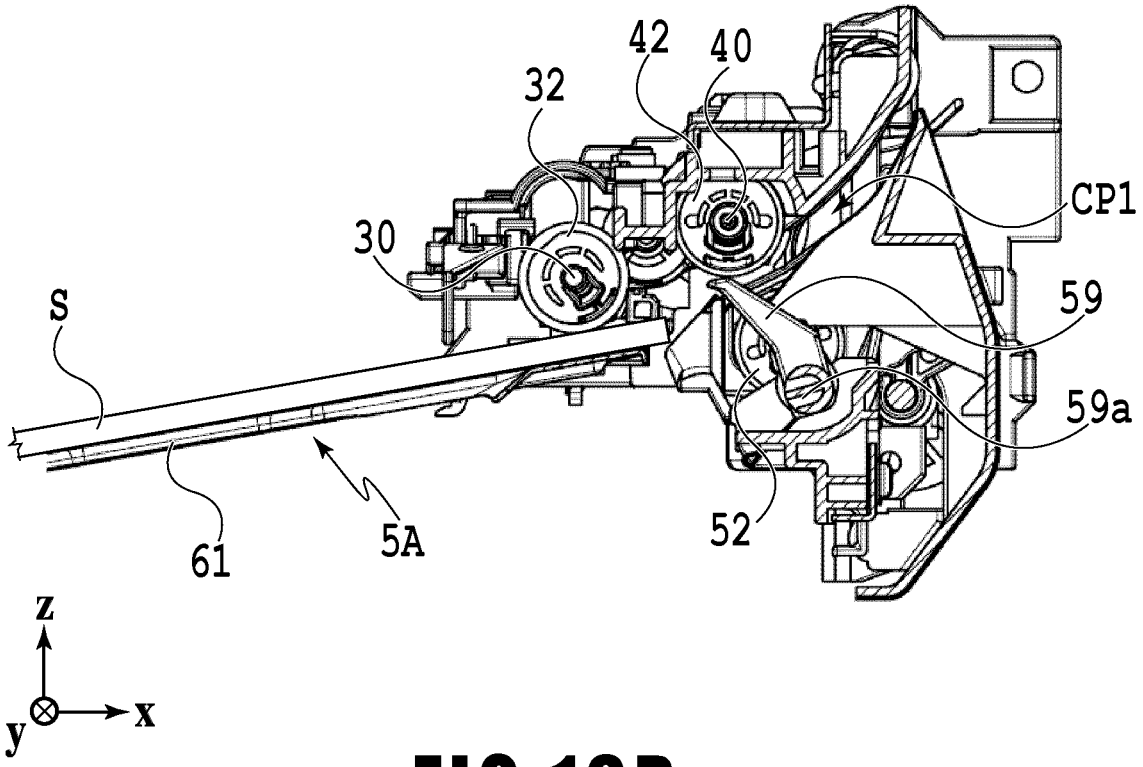

The top sheet of the print media S is conveyed to the print head 8 by the conveying roller 7 and the pinch roller 7*a* and ink is ejected from the print head 8 so as to print an image. During the printing operation, it is necessary to reduce the load of conveying the print medium S by the conveying roller 7. Accordingly, as illustrated in FIG. 16B, printing is performed in a state where the separation roller 52 separates from the second feeding roller 42 and nipping by both rollers is released. In addition, there may be a case where the conveying roller 7 and the first feeding roller 32 simultaneously contact a same sheet of the print media S during the conveyance operation. In such a situation, it is necessary to prevent the first feeding roller 32 from working as a conveyance load of the conveying roller 7. Therefore, increase of conveyance load for the conveying roller 7 is suppressed by coupling the one-way clutch 33 to the first feeding roller 32 and causing the first feeding roller 32 to smoothly perform following rotation in accordance with the conveyance of the print medium S.

In the present embodiment, as thus described, whereas the first feeding roller 32 in a rotation terminated state is caused to abut the top surface of the print media S in the first cassette 5A in the stand-by state before the feeding operation, the separation roller 52 is caused to abut the second feeding roller and the return member 59 is moved to the retracted position. Accordingly, even in the case where a plurality of sheets of the print media are fed from the first cassette 5A in an overlapped manner due to the feeding operation, these double-fed print media are separated by the second feeding roller and the separation roller 52 into the top print medium and the print media thereunder of the print media. In other words, the second feeding roller and the separation roller 52 are already kept in a stable contacting state in the stand-by state before the feeding operation is started, and therefore it becomes possible to reliably separate the double-fed sheets of the print media.

Therefore, the possibility of feeding a plurality of sheets of the print media to the conveying path CP1 significantly decreases, and it becomes possible to reduce the waste of printing operation that may occur due to double-feed. In other words, it becomes possible to suppress printing operations performed across a plurality of sheets of the print media and discharge of blank sheets, occurrence of jam due to double-feed, and waste of ink or the print media consumed during an inappropriate printing operation due to double-feed.

Figure 17:
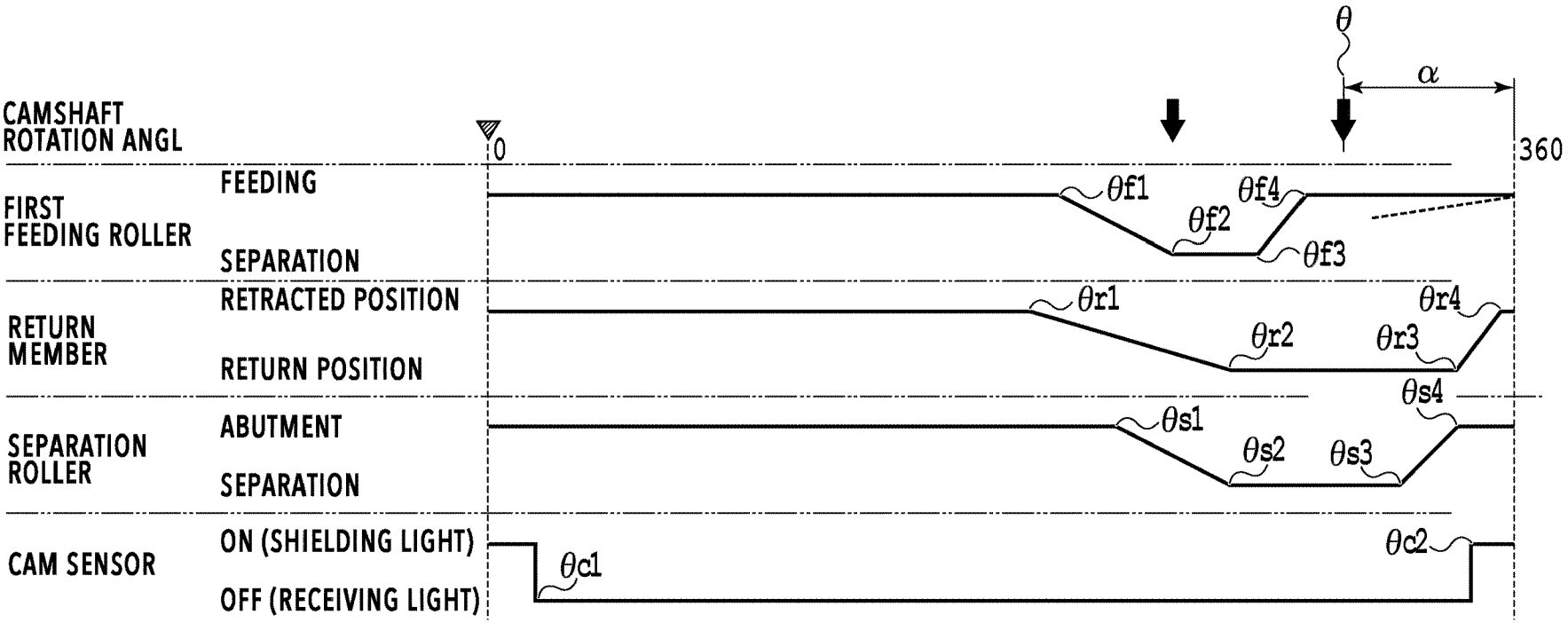
FIG. 17 is a flowchart illustrating the operation timing of each part in the feeding apparatus.
Figure 18:
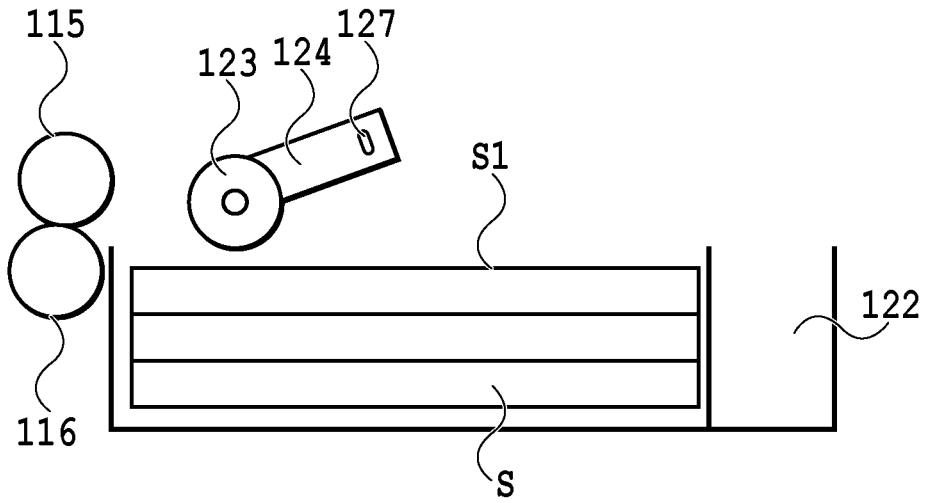
FIG. 18 illustrates a conventional feeding apparatus.

FIG. 17 is a timing chart indicating operation timings of respective members in a series of feeding operations described above. The timing chart indicates the timings at which respective members of the feeding unit 6A (the feeding roller holding member 55, the return member 59, and the separation roller 52) operate while the camshaft 57 rotates once, and output signals (ON signal and OFF signal) of a cam sensor 160. The cam sensor 160 includes a rotating plate 161 provided on the return member cam 60, and a photo interrupter 162 facing the rotating plate 161. The cam sensor 160 outputs an ON signal in a state where the light-shielding part of the rotating plate 161 exists between a light-emitting part and a light-receiving part included in the photo interrupter 162, and an OFF signal in a state where the light-shielding part of the rotating plate 161 does not exist between the light-emitting part and the light-receiving part, respectively.

Feeding of the print media S is performed while the camshaft 57 rotates from an initial position (0 degree) to θf1 degrees. Upon the camshaft 57 rotating to θf1 degrees, the first feeding roller 32 rotationally moves (ascends) around the second roller shaft 40. Upon the camshaft 57 rotating to θf2 degrees, the first feeding roller 32 completely separates from the top sheet of the print media S housed in the first feeding cassette 5A. The separation state continues until the rotation angle of the camshaft 57 reaches θf3 degrees.

Upon the rotation angle of the second roller shaft 40 reaching θf3 degrees, the first feeding roller 30 rotationally moves (descends) around the second roller shaft 40. Subsequently, at a time point at which the camshaft 57 has rotated to θf4 degrees, the first feeding roller 32 abuts the top sheet of the print media S in the first cassette 5A. The abutting state continues until the feeding operation is completed (up to θf1 degrees).

Note that the angle range (angle range of α degrees (the period indicated by the generally dashed line in the drawing)) in which the camshaft 57 reaches the initial position (0 degree (=360 degrees)) from θ degrees turns out to be an angle range in which the rotation force of the second roller shaft 40 is not transmitted to the first feeding roller 32. In other words, the angle range of interest is the aforementioned delay period.

In addition, upon the camshaft 57 rotating to the angle θr1, the return member 59 starts moving from the retracted position toward the return position. Subsequently, upon the camshaft 57 rotating to θr2, the return member 59 reaches the return position. Accordingly, the remaining sheets of the print media S separated from top sheet thereof are returned to the first feeding cassette 5A. The return member 59 is held at the return position until the rotation angle of the camshaft 57 reaches the angle θr3. Upon the rotation angle of the camshaft 57 reaching the angle θr3, the return member 59 moves toward the retracted position and reaches the retracted position at the time point at which the rotation angle of the camshaft 57 has reached the angle θr4.

As thus described, the return member 59 moves to the retracted position in a predetermined period (α degrees) set within the delay period (angle θ to 360 degrees). Therefore, the print media S, whose feeding is started from the initial position (0 degree) of the camshaft 57, does not interfere with the return member 59 during the feeding operation.

In addition, the separation roller 52 is held at the abutting position (nipping position) against the second feeding roller 42 until the camshaft 57 rotates from the initial position (0 degree) to an angle θs1. Upon the camshaft 57 rotating to the angle θs1, the separation roller 52 moves in a direction away from the second feeding roller 42, and reaches a predetermined separated position at a time point at which the camshaft 57 has rotated to an angle θs2. Subsequently, the separation roller 52 is held at the separated position until the rotation angle of the camshaft 57 reaches an angle θs3.

Upon the camshaft 57 rotating to the angle θs3, the separation roller 52 moves from the separated position toward the second feeding roller 42. Subsequently, the separation roller 52 reaches the abutting position (nipping position) against the second feeding roller 42 at a time point at which the camshaft 57 has rotated to an angle θs4. As thus described, the separation roller 52 moves to the nipping position in a predetermined period (from the angle θs3 to angle θs4) set within the delay period (from the angle θ to 360 degrees). Therefore, even in the case where a plurality of sheets of the print media S are fed by the feeding operation started from the initial position (0 degree), the sheets of the print media S turn out to be nipped between the separation roller 52 and the second feeding roller 42, and reliably separated into the top sheet and sheets thereunder of the print media S.

The cam sensor 160 outputs an ON signal while the rotation angle of the camshaft 57 lies within a range from 0 degree to an angle θc1 degrees, and outputs an OFF signal while the rotation angle of the camshaft 57 lies within a range from angle θc1 degrees to an angle θc2 degrees. In other words, an ON signal is output from the cam sensor 160 while the rotation angle of the second roller shaft 40 lies within a range from the angle θc2 to the angle θc1. The print controller 202 determines the rotational position (phase) of the camshaft 57 on the basis of the detection result of the cam sensor 160.

In the aforementioned embodiment, there has been provided a configuration of separating a plurality of print media fed from the feeding cassette by nipping the sheets between the second feeding roller and the separation roller. However, the separating unit for separating the sheets of the print media may be formed using members other than the separation roller. For example, it is also possible to separate the top sheet and the other sheets of the print media by providing a nonrotatable resistance force generation member provided contactable to, and separable from, the second feeding roller, and causing the resistance force generation member to contact the sheets other than the top sheet of the print media to generate resistance force.

Furthermore, in the aforementioned embodiment, the second feeding roller rotated by the driving force of the feeding motor is used as a member (nip member) for nipping the print medium together with a separation member such as the separation roller. However, a nip member for nipping the print medium together with a separation member may be formed of a roller that performs following rotation by contacting the print medium. Furthermore, it is also possible to form the nip member with a member having a lower sliding resistance against the print medium than that of the separation member.

In addition, the driving source that provides driving force to the first feeding roller 32, the separation roller 52, and the return member 59 is not limited to the feeding motor and other actuators may also be used. For example, a solenoid, cylinder, or the like may also be used.

In addition, although an example including the first and the second cassettes 5A and 5B has been described above, it is also possible to provide a larger number of cassettes. In such a case, it suffices to provide a feeding unit having a similar configuration to the feeding unit illustrated in the aforementioned embodiment.

Furthermore, the present invention is also applicable to a printing apparatus using a printing method other than inkjet printing. For example, the present invention is applicable to various types of printing apparatuses such as the printing apparatus that performs printing by electrophotography, or the thermal printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-246816, filed Dec. 22, 2017, which is hereby incorporated by reference herein in its entirety.

What is claimed is:

1. A sheet feeding apparatus comprising:

a stacking part configured to stack sheets;

a first feeding roller which is movable to an abutting position at which the first feeding roller contacts a sheet stacked on the stacking part and to a separated position separated from the sheet stacked on the stacking part and configured to feed the sheet by rotating at the abutting position;

a second feeding roller contacting a sheet fed outside from the stacking part, and rotating in conjunction with the first feeding roller, a separation member configured to separate the sheet, the separation member being movable to a contact position at which the sheet is nipped between the separation member and the second feeding roller, and a non-contact position at which the sheet is not contacted; and a return unit configured to perform a return operation of returning sheets other than a top sheet which the first feeding roller abuts, wherein the first feeding roller moves to the separated position after feeding the sheet from the stacking part, and the return unit performs the return operation upon the first feeding roller moving to the separated position and the separation member moving to the non-contact position.

2. The sheet feeding apparatus according to claim 1, wherein a driving force from a predetermined driving source is transmitted to the first feeding roller via a one-way clutch, and the one-way clutch is rotatable in a forward rotation direction for feeding a sheet from the stacking part, and prevented from rotating in a reverse direction that is reverse of the forward rotation direction.

3. The sheet feeding apparatus according to claim 2, further comprising a delay mechanism configured to transmit the driving force generated from the predetermined driving source to the first feeding roller over a predetermined delay period.

4. The sheet feeding apparatus according to claim 1, wherein the first feeding roller is held by a feeding roller movement unit, the feeding roller movement unit includes:

a roller holding member holding the first feeding roller in a freely rotatable manner and being supported in a reciprocally movable manner; and a holding member movement unit configured to reciprocally move the roller holding member, the first feeding roller moves to an abutting position at which the first feeding roller abuts the top surface of a top sheet of the sheets stacked on the stacking part due to a forward movement of the roller holding member, and the first feeding roller moves to the separated position due to a backward movement of the roller holding member.

5. The sheet feeding apparatus according to claim 4, wherein the holding member movement unit includes:

a motor;

a camshaft configured to be rotated by the motor;

a feeding roller movement cam configured to rotate together with the camshaft, and move the first feeding roller from the abutting position to the separated position; and a feeding roller biasing member configured to bias the first feeding roller so as to move from the separated position to the abutting position.

6. The sheet feeding apparatus according to claim 1, wherein the separation member generates resistance force against movement of a sheet at the contact position.

7. The sheet feeding apparatus according to claim 6, wherein the separation member includes a separation roller, and the separation roller provides a resistance force against movement of a sheet at the contact position.

8. The sheet feeding apparatus according to claim 7, wherein a torque limiter configured to apply braking to rotation of the separation roller is coupled to the separation roller.

9. The sheet feeding apparatus according to claim 1, wherein the separation member is held by the separation member movement unit, and the separation member movement unit includes:

a motor;

a camshaft configured to be rotated by the motor; and a separation member movement cam configured to rotate together with the camshaft, and move the separation member to the contact position and the non-contact position.

10. The sheet feeding apparatus according to claim 1, wherein the return unit includes:

a motor;

a camshaft configured to be rotated by the motor; and a return member configured to rotate together with the camshaft, and move to a position at which a second sheet and subsequent sheets of the sheets are returned to the stacking part, and a retracted position at which the sheets are not contacted.

11. The sheet feeding apparatus according to claim 1, wherein, after the return operation, in the state in which the separation member is positioned at the non-contact position, the first feeding roller moves to the abutting position.

12. A printing apparatus comprising:

a stacking part configured to stack sheets;

a first feeding roller which is movable to an abutting position at which the first feeding roller contacts a sheet stacked on the stacking part and to a separated position separated from the sheet stacked on the stacking part and configured to feed the sheet by rotating at the abutting position;

a second feeding roller contacting a sheet fed outside from the stacking part, and rotating in conjunction with the first feeding roller;

a separation member configured to separate the sheet, the separation member being movable to a contact position at which the sheet is nipped between the separation member and the second feeding roller, and a non-contact position at which the sheet is not contacted;

a conveying unit configured to convey the sheet fed by the second feeding roller to a print area along the conveying path;

a printing unit configured to perform printing on the conveyed sheet, a return unit configured to perform a return operation of returning the sheets other than a top sheet which the first feeding roller abuts, wherein the first feeding roller moves to the separated position after feeding the sheet from the stacking part, and the return unit performs the return operation upon the first feeding roller moving to the separated position and the separation member moving to the non-contact position.

* * * * *